US006305193B1

(12) United States Patent
Cheng

(10) Patent No.: US 6,305,193 B1
(45) Date of Patent: Oct. 23, 2001

(54) GEMSTONE

(75) Inventor: Nai Yan Cheng, Kowloon (HK)

(73) Assignee: Continental Jewelry (USA) Inc., New York, NY (US)

( * ) Notice: Subject to any disclaimer, the term of this patent is extended or adjusted under 35 U.S.C. 154(b) by 0 days.

(21) Appl. No.: 09/690,432

(22) Filed: Oct. 17, 2000

(51) Int. Cl.[7] ..... A44C 17/00
(52) U.S. Cl. ..... 63/32; D11/89; D11/90
(58) Field of Search ..... 63/26, 32; D11/89, D11/90, 91, 92

(56) References Cited

U.S. PATENT DOCUMENTS

| | | | | |
|---|---|---|---|---|
| D. 140,283 | * | 2/1945 | Heller | D11/90 |
| D. 141,258 | * | 5/1945 | Fine | D11/90 |
| D. 141,259 | * | 5/1945 | Fine | D11/90 |
| D. 143,470 | | 1/1946 | Fine . | |
| D. 238,355 | * | 1/1976 | Pierson | D25/32 |
| D. 330,875 | | 11/1992 | Kaplan . | |
| D. 333,108 | * | 2/1993 | Akselrod | D11/90 |
| D. 354,014 | * | 1/1995 | Cohen | D11/90 |
| D. 419,104 | * | 1/2000 | Ceulemans | D11/90 |
| D. 431,492 | * | 10/2000 | Wagemans | D11/90 |
| 3,286,486 | | 11/1966 | Huisman et al. . | |
| 3,490,250 | | 1/1970 | Jones . | |
| 3,585,764 | | 6/1971 | Huisman et al. . | |
| 3,763,665 | | 10/1973 | Polakiewicz . | |
| 3,788,097 | | 1/1974 | Elbe . | |
| 3,875,760 | | 4/1975 | Jones . | |
| 4,118,949 | | 10/1978 | Grossbard . | |
| 5,533,364 | | 7/1996 | Freilich . | |
| 5,657,646 | | 8/1997 | Rosenberg . | |
| 5,657,647 | | 8/1997 | Freiesleben . | |
| 5,761,929 | | 6/1998 | Freilich . | |
| 6,006,548 | | 12/1999 | Freilich . | |

OTHER PUBLICATIONS

Eric Bruton F.G.A., "Some Variations of the Brilliant Cut", DIAMONDS 2nd edition, 1981, p. 222.

* cited by examiner

*Primary Examiner*—B. Dayoan
*Assistant Examiner*—Andrea Chop
(74) *Attorney, Agent, or Firm*—Baker Botts L.L.P.

(57) ABSTRACT

A gemstone includes a pavilion portion, a crown portion and a girdle portion provided between the pavilion portion and the crown portion. The crown portion includes a plurality of facets provided on a surface thereof. The crown portion can have eight longitudinal sections which collectively define it. At least one of the longitudinal sections includes a predetermined number of particular facets of the plurality of facets. Each of the particular facets has at least one edge that borders the girdle portion. A single facet of the particular facets is formed from cutting at least portions of at least two further facets of the particular facets. The gemstone can also be subdivided into two longitudinal half sections, with the crown portion of which having 12 facets that border the girdle portion of the longitudinal half section.

19 Claims, 6 Drawing Sheets

GEMSTONE

FIELD OF THE INVENTION

The present invention relates to a gemstone which has a particular number of facets on the facet portion thereof. In particular, the gemstone may include certain facets that may enhance the brilliance of the gemstone.

BACKGROUND INFORMATION

Generally, facets on precious and semi-precious gemstones are cut so as to provide a brilliance to these gemstones in an economical manner. The way to cut the gemstones to provide particular facets thereon and the locations of these facets on the gemstones are well known in the art. FIGS. 1–4 show an exemplary illustration of a conventional gemstone 10 having a prior art configuration of facets on the surface of the gemstone 10. In particular, FIG. 1 shows a side view of the conventional round-shaped gemstone 10. The conventional gemstone 10 includes a crown 20 and a pavilion 30. The crown 20 is provided above the pavilion 30, and is separated from the pavilion 30 by a girdle 40. The crown 20 and the pavilion 30 have particular facets provided thereon. As known to those having ordinary skill in the art, these facets are arranged to enhance the brilliance of the gemstone 10. FIG. 2 shows separate portions of the conventional gemstone 10, i.e., the crown 20, the pavilion and an enlarged illustration of the crown 40.

FIG. 3 shows an enlarged side view and FIG. 4 shows an enlarged top view of the crown 20 of the conventional gemstone 10. The crown 20 includes a flat table 50 which has a shape of an octagon and is disposed on top of the crown 20. In addition, facets are provided on a diagonally extending side 25 of the crown 20. These facets include star facets 110 (each having a shape of a triangle), upper main facets 120 (each having four sides), left-side upper girdle facets 130 (each having a pointed end directed to the left side), and right-side upper girdle facets 140 (each having a pointed end directed to the right side). The crown generally has eight star facets 110, eight upper main facets 120, eight left-side upper girdle facets 130 and eight right-side upper girdle facets 140. Accordingly, the crown 20 has a total of thirty-two (32) facets and the table 50 (which can be considered as another facet) provided thereon.

The longest edges 115 of the star facets 110 form edges 55 of the table 50. A right edge 118 of each star facet 110 forms a shorter left edge 126 of a respective upper main facet 120. A left edge 117 of each star facet 110 forms a shorter right edge 128 of another upper main facet 120. A right edge 137 of each left-side upper girdle facet 130 forms a longer left edge 124 of a respective upper main facet 120, while a left edge 135 of the same left-side upper girdle facet 130 forms a longer right edge 122 of another upper main facet 120. Bottom edges 138 of the left-side upper girdle facets 130 and bottom edges 148 of the right-side upper girdle facets 140 collectively form an upper edge 45 of the girdle 40.

Using this configuration of the facets of the crown 20, is was possible to obtain a brilliance effect with the conventional gemstone 10 which was generally acceptable to a consumer.

SUMMARY OF THE PRESENT INVENTION

The object of the present invention is to provide a better effect on a scintillation, i.e., a sparkle of the gemstone when its is irradiated in light and moved, which is caused by a light reflection of the light within the gemstone.

Thus, a gemstone according to an exemplary embodiment of the present invention is provided to achieve this object. The gemstone includes a pavilion portion, a crown portion and a girdle portion provided between the pavilion portion and the crown portion. The crown portion includes a plurality of facets provided on a surface thereof. The crown portion can have eight longitudinal sections which collectively define it. At least one of the longitudinal sections includes a predetermined number of particular facets. Each of the particular facets has at least one edge that borders the girdle portion. A single facet of the particular facets is formed from cutting at least portions of at least two further facets of the particular facets In another embodiment of the present invention, each one of the predetermined facets includes at least one further edge that borders another one of the predetermined facets within a particular longitudinal section of the crown portion. Each of the longitudinal sections may include the predetermined number of the particular facets. All of the longitudinal sections may also have substantially the same dimensions.

In a further embodiment of the present invention, first four consecutive longitudinal sections can define a first half of the crown portion, and second four consecutive longitudinal sections can define a second half of the crown portion. In this embodiment according to the present invention, the first half and the second half form the crown. Additionally, all edges of the particular facets which border the girdle portion may collectively define an upper edge of the girdle portion. In addition, at least one edge of each of the particular facets which border the girdle portion may have a curved shape.

Another embodiment of the present invention provides that there are three facets arranged on the longitudinal section. Each of the first and second facets within a first section of the longitudinal sections have two first parallel edges. The third facet has edges which border particular parallel edges of the first and second facets. In addition, the girdle portion generally extends along a first plane, and at least one of the particular facets extends along a second plane. It is preferable for the first plane to be provided at a predetermined angle with respect to the second plane, such angle being between approximately 43.7° and 50.7°.

In yet another embodiment of the present invention, the gemstone can be logically subdivided into two longitudinal half sections. The crown portion of at least one the longitudinal half section has 12 facets that border the girdle portion of the longitudinal half section.

BRIEF DESCRIPTION OF THE DRAWINGS

Further objects, features, and advantages of the present invention will become apparent upon consideration of the following detailed description of the presently preferred embodiments when taken in conjunction with the accompanying drawings, wherein.

DETAILED DESCRIPTION

Figure 5:
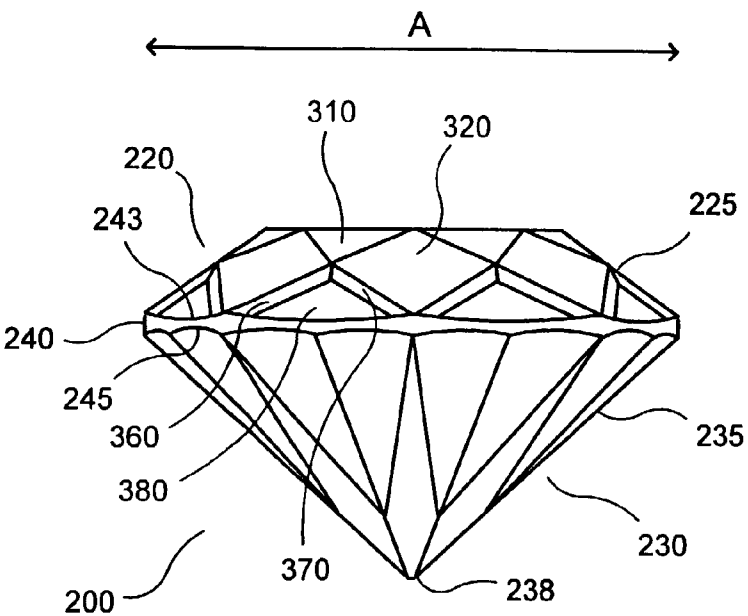
FIG. 5 shows an enlarged side view of an exemplary embodiment of the gemstone according to the present invention.

An exemplary embodiment of a gemstone 200 according to the present invention is shown in FIGS. 5–10. FIG. 5 shows an enlarged side view of the gemstone 200 which has a round shape as viewed from top or bottom views (e.g., see FIGS. 8 and 9). However, it is possible that another embodiment of the gemstone of 200 of the present invention may have other shapes (e.g., an oval shape, a marquis shape, etc.). The gemstone 200 can be a precious stone (such as a diamond) or a semi-precious stone.

Figure 2:
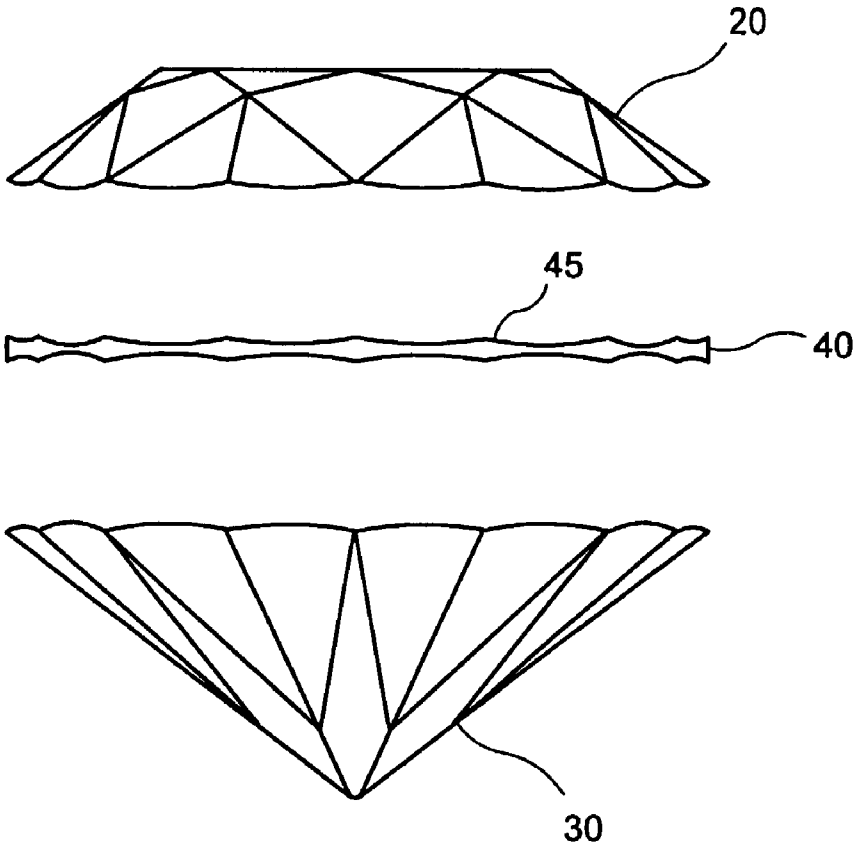
FIG. 2 PRIOR ART
FIG. 2 shows a side view of different portions of the conventional gemstone of FIG. 1.
Figure 1:
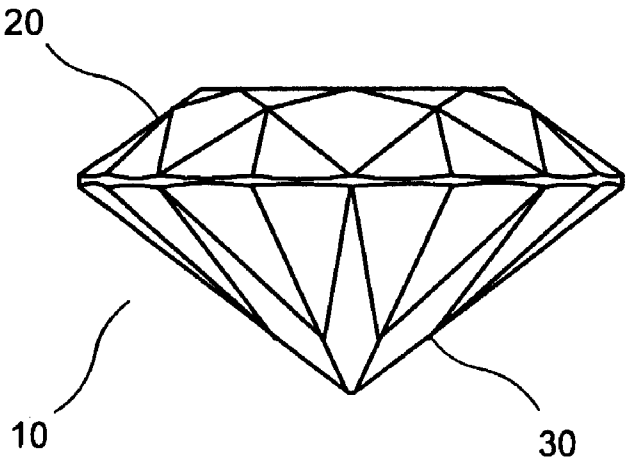
FIG. 1 PRIOR ART
FIG. 1 shows a side view of a conventional gemstone.
Figure 3:
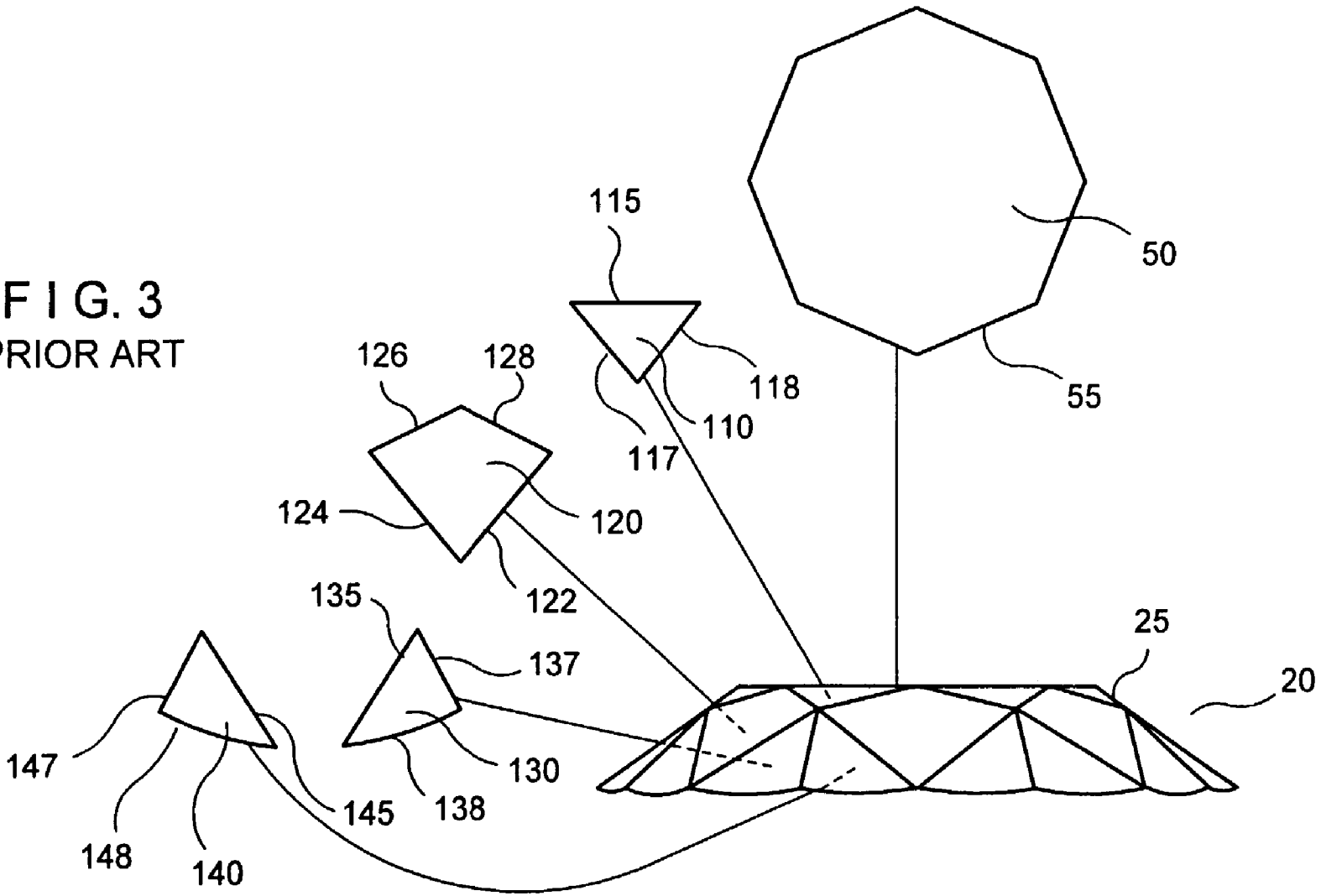
FIG. 3 PRIOR ART
FIG. 3 shows an enlarged side view of a crown of the conventional gemstone of FIG. 1, and facets provided on the crown.
Figure 4:
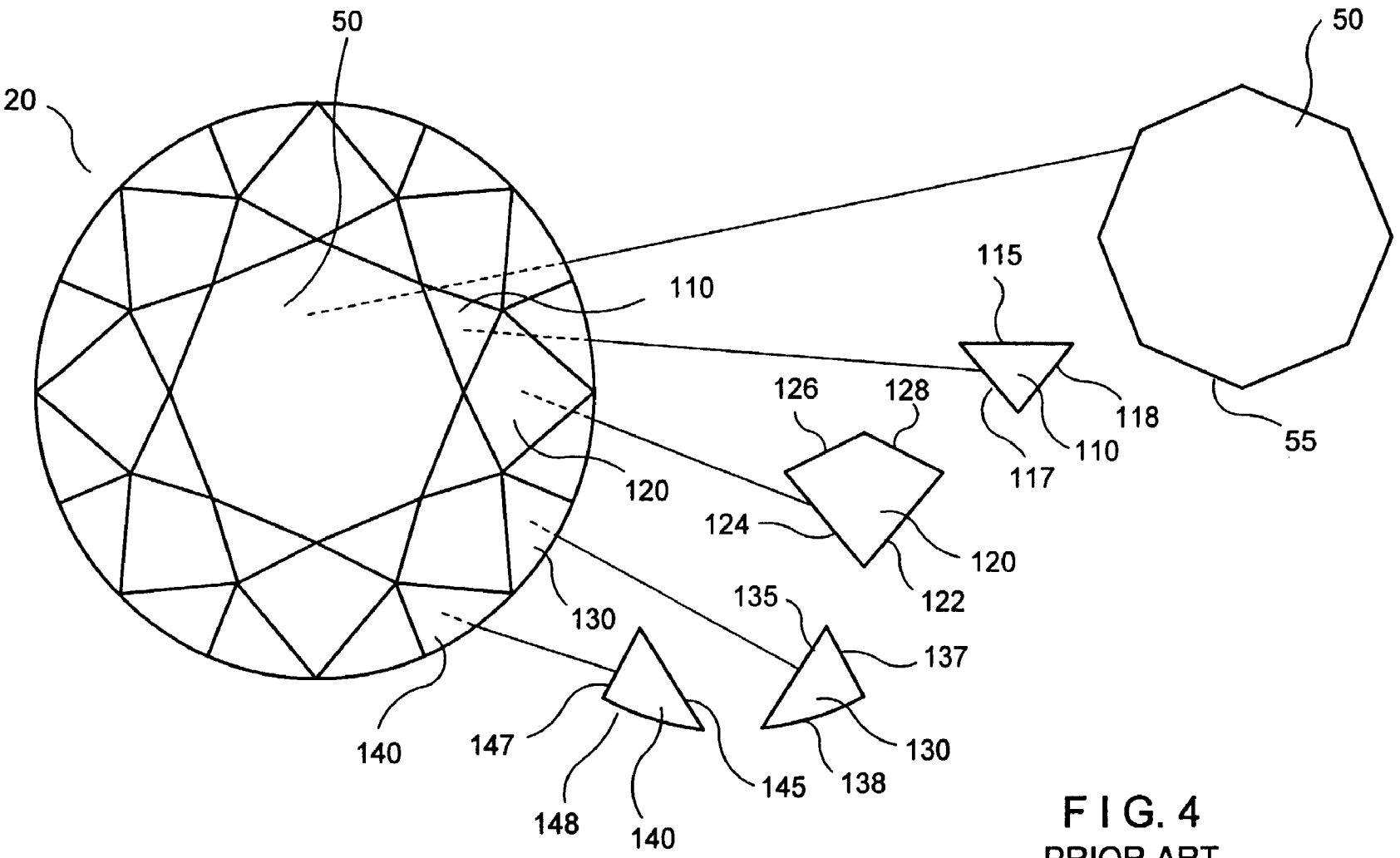
FIG. 4 PRIOR ART
FIG. 4 shows an enlarged top view of the crown of the gemstone illustrated in FIG. 1, and the facets provided on the crown.
Figure 6:
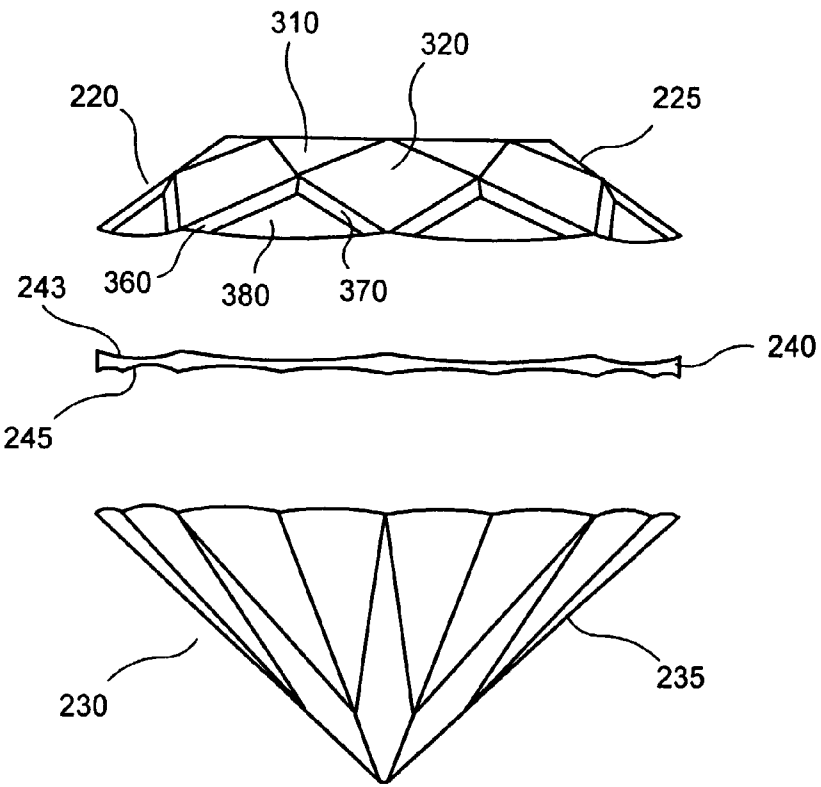
FIG. 6 shows a side view of different portions of the gemstone of FIG. 5.
Figures 7, 8, 9:
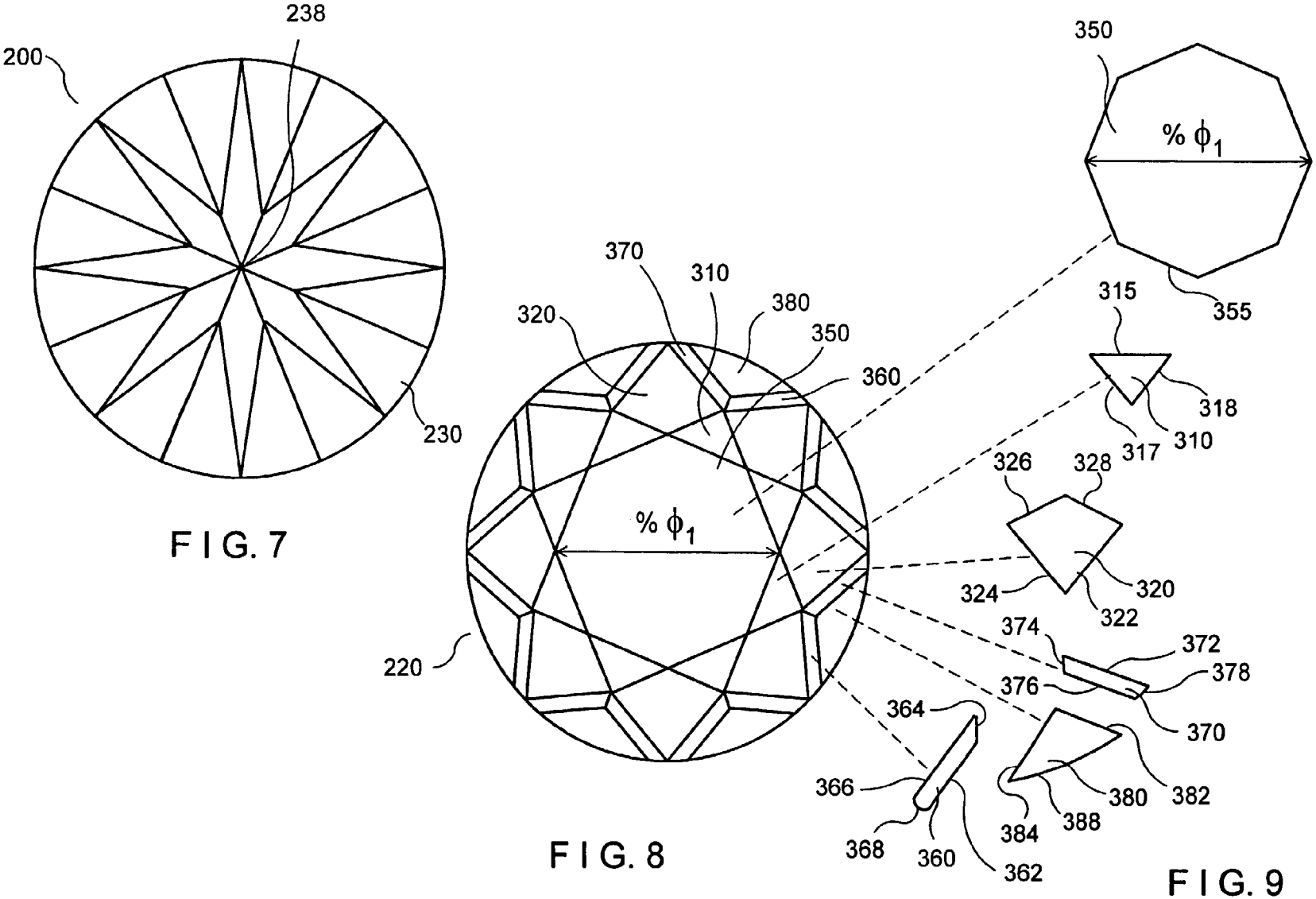
FIG. 7 shows an enlarged bottom view of the gemstone illustrated in FIG. 5.
FIG. 8 shows an enlarged top view of the gemstone illustrated in FIG. 5.
FIG. 9 shows a top view of exemplary facets of the gemstone according to the present invention.

Similarly to the conventional gemstone 10 of FIG. 1, the gemstone 200 according to the present invention as illustrated in FIGS. 5 and 6 includes a crown 220, a pavilion 230, a girdle 240, and particular facets provided on the crown 220. An enlarged bottom view of the pavilion 230 is shown in FIG. 7, and an enlarged top view of the crown is shown in FIG. 8. The crown 220 is provided above the pavilion 230, and is separated from the pavilion 230 by the girdle 240. The crown 220 has a table 350 and facets provided thereon. The facets are defined by a substantially straight edges. However, for the facets that border the girdle 240, at least one the such edges are not necessarily extend in a straight line. It is preferable that these edges have a curved shape so as to form a curved (e.g., round or oval) edge of the girdle 240.

The facets of the crown 220 preferably include are eight star facets 310, and eight upper main facets 320. According to the present invention, further facets are provided on the crown 220 of the gemstone 200. As described above, the conventional gemstone 10 includes eight left-side upper girdle facets 130 and eight right-side upper girdle facets 140 that are provided or produced on the crown 20. In contrast, the crown 220 of the gemstone 200 according to the present invention has eight left-side partial girdle facets 360, eight right-side partial girdle facets 370 and eight middle girdle facets 380. Thus, the total number of facets provided or created on the crown 220 of the gemstone 200 is 40 (not including the table 350). Therefore, according to the above-described exemplary embodiment of the present invention, the crown 220 of the gemstone 200 has eight (8) extra facets thereon. These eight additional facets 360, 370, 380 provide a better effect on the scintillation, which is caused by a light reflection of the light within the gemstone 200. The pavilion 230 includes twenty-four (24) facets, which is the same number of pavilion facets provided on the conventional gemstone 10. Accordingly, the total number of facets provided on the gemstone 200 according to the present invention is sixty-five (65), which includes the table 350 as one of the facets.

It should be noted that the facets 360, 370, 380 can be provided or produced by cutting particular sections of the crown 20 of the conventional gemstone 10 and possibly certain sections of the girdle 40. Each of the sections of the crown 20 to be cut is provided between one respective left-side upper girdle facet 130 and one respective right-side upper girdle facet 140. In addition, each of the sections of the girdle 40 to be cut borders the bottom edge 138 of the respective left-side upper girdle facet 130 and the bottom edge 148 of the respective right-side upper girdle facet 140. These sections are preferably cut so that the portions of the respective left-side and right-side upper girdle facets 130, 140 are substantially equal. Thus, the surface areas of the facets 360, 370 should also be substantially the same. By providing eight additional facets on the gemstone 200 of the present invention, it is possible to obtain a better brilliance of the gemstone, while losing only 2% (approximately) of the gemstone's carat weight.

In this manner, it is possible to form the facets 360, 370, 380 of the crown 220 of the gemstone 200 shown in FIGS. 5 and 6. It is also possible to cut the facets 360, 370, 380 without first creating the left-side and right-side upper girdle facets 130,140 by making or cutting each of the facets 360, 370, 380 separately. It should be understood that the above-described sections of the gemstone 10 are cut in a matter that is well known to those having ordinary skill in the art.

FIG. 8 shows an enlarged top view of the gemstone 200 according to the present invention, and FIG. 9 shows an exploded top view of the table 350 and the facets 310, 320, 360, 370, 380 of the gemstone 200. In particular, the longest edges 315 of the star facets 310 form edges 355 of the table 350. A right edge 318 of each star facet 310 forms a shorter left edge 326 of a respective upper main facet 320. A left edge 317 of each star facet 310 forms a shorter left edge 328 of another upper main facet 320. A left-side edge 366 of each partial left-side upper girdle facet 360 forms a longer right edge 322 of a respective upper main facet 320. A right-side edge 372 of each partial right-side upper girdle facet 370 forms a longer left edge 324 of another upper main facet 320.

A short right-side edge 364 of each partial left-side upper girdle facet 360 contacts a short left-side edge 374 of the respective partial right-side upper girdle facet 370. A left edge 384 of each middle girdle facet 380 contacts a long right-side edge 362 of the respective partial left-side upper girdle facet 360, and a right edge 382 of the same middle girdle facet 380 contacts a long left-side edge 376 of another one of the partial right-side upper girdle facets 370. Bottom edges 368, 378, 388 of the upper girdle facets 360, 370, 380 collectively form an upper edge 243 of the girdle 240.

Figure 10:
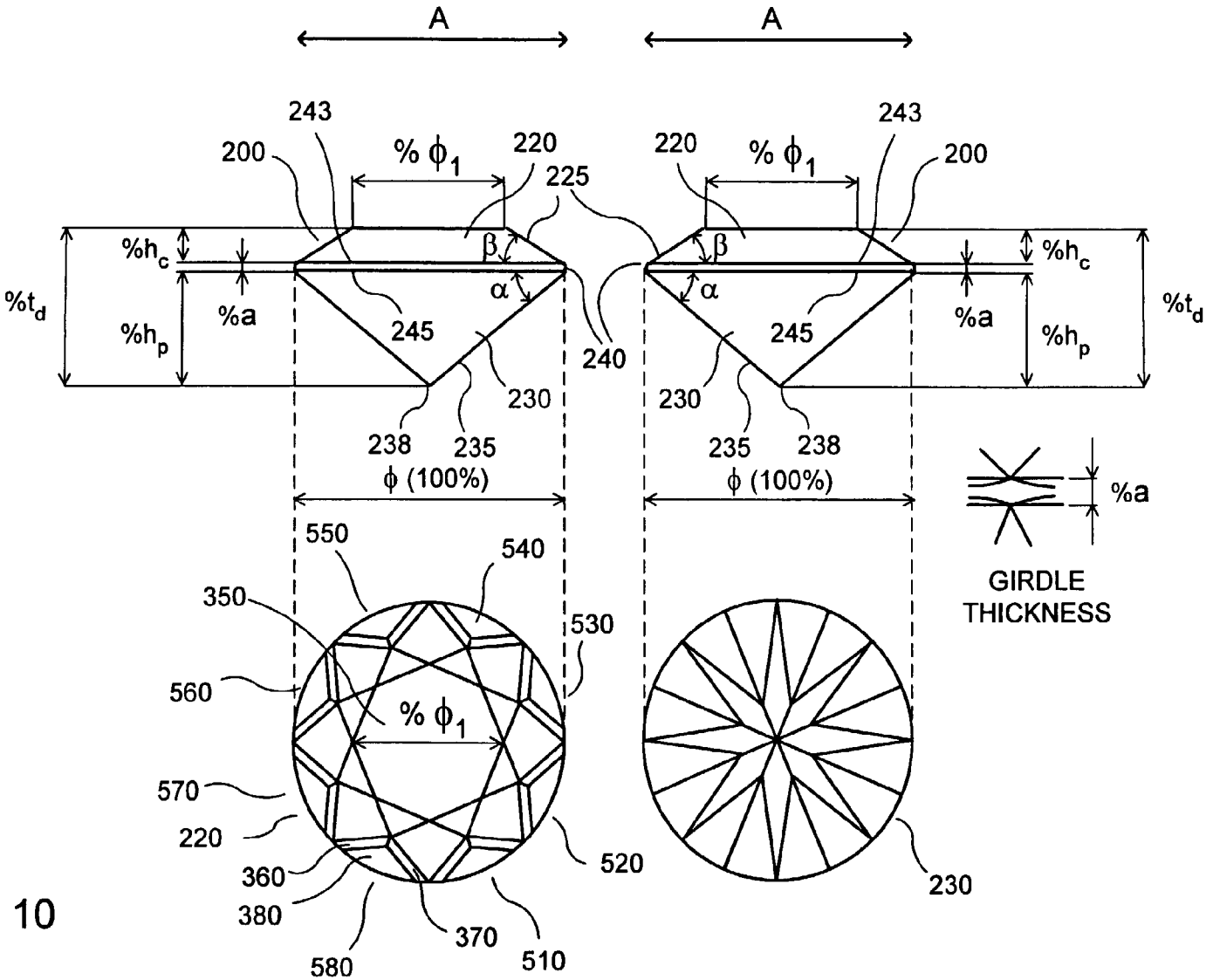
FIG. 10 shows a side view of the gemstone illustrated in FIG. 5 with relative dimensions of particular portions of the gemstone being provided.

To further explain the gemstone 200 of the present invention, the gemstone 200 can be conceptually subdivided into eight longitudinally-extending sections 510–580, as shown in FIG. 10. In particular and when viewed from above, each section of the gemstone 200 includes at least one partial left-side upper girdle facet 360, at least one partial right-side upper girdle facet 370 and at least one middle girdle facet 380. Thus, at least three facets 360, 370, 380 of each section have edges that border the girdle 240. According to the present invention, it is also conceivable that each of the sections 510–580 has other facets that border the girdle (e.g., preferably up to five facets in total). In addition, each section preferably includes at least one star facet 310.

FIG. 10 also illustrates side views of the gemstone 200 according to the present invention with relative exemplary dimensions of particular portions of the gemstone being provided therein. In particular, the relative diameter $\phi$ of the girdle 240 of the gemstone 200 is set at 100%, and extends in a direction A along the diameter $\phi$. As such, the diameter $\phi$ of the girdle 240 shall serve for the description below as a reference size for other dimensions of the gemstone 200 according to the present invention. A diagonal side 225 of the crown 220 may extend at a crown angle β of between approximately 32° and 37.5° as measured with respect to the diameter ϕ of the girdle 240. A diagonal side 235 of the pavilion 230 may extend at a pavilion angle α of approximately 39.6° and 42.2° as measured with respect to the diameter ϕ of the girdle 240. Each middle girdle facet 380 is provided at a facet angle which is between approximately 43.7° and 50.7° as measured with respect to the direction A.

A width $\phi_1$ of the table 350 is approximately 53% to 66% in comparison with the diameter ϕ of the girdle 240. The crown 220 has a crown height $h_c$ (measured from the table 350 of the crown 230 to an upper edge 243 of the girdle 240) of approximately 11% to 16% compared to the diameter ϕ of the girdle 240. The girdle 240 has a girdle thickness a of approximately 2% to 4.5% in a relative comparison with the diameter ϕ of the girdle 240. The pavilion 230 has a pavilion height $h_p$ (measured from a pointed portion 238 of the pavilion 230 to a lower edge 245 of the girdle 240) of approximately 41.5% to 45% compared to the diameter ϕ of the girdle 240. A total height $T_d$ of the gemstone 200 (measured from the table 350 to the pointed portion 238 of the pavilion 230) may be approximately 55.5% to 63.9% compared to the diameter ϕ of the girdle 240.

As an example, if the gemstone 200 has a carat weight of 2.5 carats, the diameter ϕ of the girdle 240 may be 10 mm. Accordingly, the table width $\phi_1$ can be between 5.3 mm and 6.6 mm, the crown height $h_c$ may be between 1.1 mm and 1.6 mm, the girdle thickness a may be between 0.2 mm and 0.45 mm, the pavilion height $h_p$ can be between 4.15 mm and 4.5 mm, and the total height $T_d$ is preferably between 5.55 mm and 6.39.

The above-described relative dimensions are exemplary. Indeed, other crown, pavilion and middle facet angles, as well as different relative dimensions of the gemstone 200 are also conceivable, and are within the scope of the present invention. It should be appreciated that those skilled in the art will be able to devise numerous embodiments which, although not explicitly shown or described herein, embody the principles of the invention and are thus within the spirit and scope of the present invention.

What is claimed is:

1. A gemstone comprising:

a pavilion portion:

a crown portion including a plurality of facets provided on a surface thereof; and a girdle portion provided between the pavilion portion and the crown portion, wherein the crown portion has eight substantially identical longitudinal sections which collectively define the crown portion, wherein the girdle portion has eight girdle sections collectively defining the girdle portion, wherein at least one of the longitudinal sections includes a predetermined number of the plurality of facets, wherein exactly three of the predetermined facets are particular facets having edges which abut the entire periphery of at least one of the girdle sections, wherein a first facet of the particular facets has only three edges, a first edge of the three edges abutting an edge of a second facet of the particular facets, a second edge of the three edges abutting an edge of a third facet of the particular facets, and a third edge of the three edges abutting the at least one of the girdle sections, and wherein at least two of the particular facets each includes at least one further edge that borders another one of the predetermined facets within a respective one of the longitudinal sections of the crown portion.

2. The gemstone according to claim 1, wherein each of the longitudinal sections includes exactly three particular facets.

3. The gemstone according to claim 1, wherein first four consecutive longitudinal sections define a first half of the crown portion, and second four consecutive longitudinal sections define a second half of the crown portion, and wherein the first half and the second half form the crown portion.

4. The gemstone according to claim 1, wherein all of the edges of the particular facets that border the girdle portion collectively define an upper edge of the girdle portion.

5. The gemstone according to claim 1, wherein at least one edge of each of the particular facets which border the girdle portion has a curved shape.

6. The gemstone according to claim 1, wherein the girdle portion extends along a first plane, and at least one of the particular facets extends along a second plane, and wherein the first plane is provided at a predetermined angle with respect to the second plane, the predetermined angle being between approximately 43.70 and 50.70.

7. The gemstone according to claim 1, wherein the at least one of the longitudinal sections includes at least one further facet that does not border the girdle portion.

8. A gemstone comprising:

a pavilion portion;

a crown portion including a plurality of facets provided on a surface thereof; and a girdle portion provided between the pavilion portion and the crown portion, wherein the crown portion has eight longitudinal sections which collectively define the crown portion, wherein at least one of the longitudinal sections includes a predetermine number of particular facets of the plurality of facets, each of the particular facets having at least one edge that borders the girdle portion, wherein a first facet of the particular facets within a first section of the longitudinal sections has two first parallel edges, wherein a second facet of the particular facets within the first section has two second edges, and wherein a third facet of the particular facets within the first section has two third edges, one of the third edges bordering one of the first parallel edges, and another one of the third edges bordering one of the second edges.

9. The gemstone according to claim 8, wherein the second edges are parallel to one another.

10. A gemstone comprising:

two substantially identical longitudinal half sections, at least one of the half sections including a pavilion portion, a crown portion and a girdle portion provided between the pavilion portion and the crown portion, the crown portion including a plurality of facets provided on a surface thereof, wherein the crown portion include a predetermined number of the plurality of facets, wherein exactly twelve of the plurality of facets are particular facets having edges which abut the entire periphery of the girdle portion, wherein a first facet of th particular facets has only three edges, a first edge of the three edges abutting an edge of a second facet of the particular facets, a second edge of the three edges abutting an edge of a third facet of the particular facets, and a third edge of the three edges abutting the girdle portion, and wherein at least one of the second and third facets includes at least one further edge that is provided between the second and third facets within the crown portion of a respective one of the longitudinal half sections.

11. The gemstone according to claim 10, wherein the longitudinal half sections have substantially the same dimensions.

12. The gemstone according to claim 10, wherein all of the edges of the particular facets that border the girdle portion collectively define an upper edge of the girdle portion.

13. The gemstone according to claim 10, wherein the at least one edge of each of the particular facets which border the girdle portion has a curved shape.

14. The gemstone according to claim 10, wherein the girdle portion extends along a first plane, and at least one of the particular facets extends along a second plane, and wherein the first plane is provided at a predetermined angle with respect to the second plane, the predetermined angle being between approximately 43.7° and 50.7°.

15. The gemstone according to claim 10, wherein the crown portion of at least one of the longitudinal half sections includes at least one further facet that does not border the girdle portion.

16. A gemstone comprising:

two longitudinal half sections, at least one of the half sections including a pavilion portion, a crown portion and a girdle portion provided between the pavilion portion and the crown portion, the crown portion including a plurality of facets provided on a surface thereof, wherein the crown portion includes a predetermined number of particular facets of the plurality of facets, each of the particular facets having at least one edge that borders the girdle portion, wherein a first facet of the particular facets within a first section of the longitudinal half sections has two first parallel edges, wherein a second facet of the particular facets within the first section has two second edges, and wherein a third facet of the particular facets within the first section has two third edges, one of the third edges bordering one of the first parallel edges, and another one of the third edges bordering one of the second edges.

17. The gemstone according to claim 16, wherein the second edges are parallel to one another.

18. A gemstone comprising:

a pavilion portion;

a crown portion including a table and a plurality of facets provided on a surface thereof; and a girdle portion provided between the pavilion portion and the crown portion, wherein the crown portion has eight substantially identical longitudinal sections which collectively define the crown portion, wherein the girdle portion has eight girdle sections collectively defining the girdle portion, wherein at least one of the longitudinal sections includes a predetermined number of the plurality of facets, wherein exactly three of the predetermined facets are particular facets having edges which abut the entire periphery of at least one of the girdle sections, wherein a first facet of the particular facets has only three edges, a first edge at the three edge abutting an edge of a second facet of the particular facets, a second edge of the three edges abutting an edge of a third facet of the particular facets, and a third edge of the three edges abutting the at least one of the girdle sections, and wherein none of the particular facets directly contact the table.

19. A gemstone comprising:

two substantially identical longitudinal half sections, at least one of the half section including a pavilion portion, a crown portion and a girdle portion provided between the pavilion portion and the crown portion, the crown portion including a table and a plurality of facets provided on a surface thereof, wherein the crown portion includes a predetermined number of the plurality of facts, wherein exactly twelve of the plurality of facets are particular facets having edges which abot the entire periphery of the girdle portion, wherein a first facet of the particular facets has only three edges, a first edge of the three edges abutting an edge of a second facet of the particular facets, a second edge of the three edges abutting an edge of a third facet of the particular facets, and a third edge of the three edges abutting the girdle portion, and wherein none of the particular facets directly contact the table.

* * * * *

UNITED STATES PATENT AND TRADEMARK OFFICE

CERTIFICATE OF CORRECTION

PATENT NO. : 6,305,193 B1
DATED : October 23, 2001
INVENTOR(S) : Nai Yan Cheng

It is certified that error appears in the above-identified patent and that said Letters Patent is hereby corrected as shown below:

Column 6,
Line 23, “43.70” should read -- 43.7º --
Line 24, “50.70” should read -- 50.7º --

Column 8,
Line 22, “at” should read -- of --
Line 31, “section” should read -- sections --
Line 40, “abot” should read -- abut --

Signed and Sealed this

Eighteenth Day of June, 2002

*Attest:*

*Attesting Officer*

JAMES E. ROGAN
*Director of the United States Patent and Trademark Office*